United States Patent [19]

Theilacker

[11] Patent Number: 4,854,237

[45] Date of Patent: Aug. 8, 1989

[54] PRINTING MACHINE CYLINDER UNDERLAY HOLDING ARRANGEMENT

[75] Inventor: Klaus Theilacker, Friedberg, Fed. Rep. of Germany

[73] Assignee: MAN - Roland Druckmaschinen AG, Offenbach am Main, Fed. Rep. of Germany

[21] Appl. No.: 31,687

[22] Filed: Mar. 27, 1987

[30] Foreign Application Priority Data

Apr. 29, 1986 [DE] Fed. Rep. of Germany ..... 3614541

[51] Int. Cl.[4] ..... B41F 27/02

[52] U.S. Cl. ..... 101/415.1; 101/389.1

[58] Field of Search ..... 101/415.1, 382 MV, 382, 101/389.1; 248/309.4; 269/8; 24/303; 51/170, 177, 275, 364, 372, 362, 367

[56] References Cited

U.S. PATENT DOCUMENTS

| | | | |
|---|---|---|---|
| 2,580,099 | 12/1951 | Jaeger | 248/309.4 X |
| 3,166,771 | 1/1965 | Kline et al. | 269/8 |
| 3,730,092 | 5/1973 | Pickard et al. | 101/415.1 |
| 3,745,626 | 7/1973 | Bray | 101/382 MV X |
| 3,827,020 | 7/1974 | Okamoto | 248/309.4 X |
| 4,040,351 | 8/1977 | Faust | 101/382 MV |
| 4,402,265 | 9/1983 | Pickard | 101/415.1 X |
| 4,625,928 | 12/1986 | Peekna | 101/415.1 X |

FOREIGN PATENT DOCUMENTS

| | | | |
|---|---|---|---|
| 186648 | 8/1956 | Austria . | |
| 0133849 | 3/1985 | European Pat. Off. | 101/382 MV |
| 1145185 | 3/1963 | Fed. Rep. of Germany . | |

OTHER PUBLICATIONS

Palmer, Allen J., Xerox Disclosure Journal, Vol. 3, #2, Mar./Apr. 1978, "Magnetic Paper-Gripping Concept", US-CL 270/18DP.

*Primary Examiner*—Edgar S. Burr
*Assistant Examiner*—James Lisehora
*Attorney, Agent, or Firm*—Frishauf, Holtz, Goodman & Woodward

[57] ABSTRACT

To adhere an underlay in the clamping groove of a printing machine cylinder, for example a blanket cylinder of a rotary sheet offset printing machine, magnetic foil strips (7, 8, 23, 24, 33) are provided, clamping the end portion (6, 22, 32) of the underlay (4, 19, 30) either between two foil strips (FIGS. 1, 2) or against a magnetic portion within the groove, typically the inner side wall surface (9, 20, 34) defining the groove. The other end portion of the underlay can be left free, and will be clamped in position by stretching the rubber blanket or printing plate, respectively, over the cylinder.

5 Claims, 1 Drawing Sheet

PRINTING MACHINE CYLINDER UNDERLAY HOLDING ARRANGEMENT

The present invention relates to printing machinery, and more particularly to an arrangement to retain an underlay for a plate or a rubber blanket on a plate or blanket cylinder, respectively, of a rotary printing machine. The invention is particularly applicable to sheet-fed rotary offset machinery, so that the ends of an underlay of paper or cardboard can be retained beneath a printing plate or rubber blanket of a cylinder by retaining the ends in an axial groove formed in the respective cylinder.

BACKGROUND

It is well known to provide printing machine cylinders with axial grooves on which essentially circular plates or rubber blankets, respectively, can be clamped. Printing machines,and especially sheet-fed offset printing machines, frequently use an intermediate underlay made of paper or cardboard in order to accurately adjust the diameter and the tensioning of the cover about a cylinder. German Pat. No. 1,145,185 describes an arrangement in which an underlay is retained in the cylinder groove in the space between the wall of the cylinder groove and a tensioning rod. The tensioning rod is eccentrically journalled or eccentrically constructed, and upon rotation of the eccentric tensioning rod, the underlay is clamped or pressed against the wall of the groove. The construction is comparatively complex and, particularly when used with large-format printing machines, requires careful adjustment and handling so that the engagement pressure throughout the axial length with be essentially uniform.

THE INVENTION

It is an object to provide an arrangement to retain an underlay on a cylinder of a rotary printing machine, and more particularly of an offset sheet-fed machine, which is simple and requires only a little handling or manual effort for installation.

Briefly, an angled-off end portion of an underlay of non-magnetic material, and which may be paper, cardboard, laminated paper or the like, is retained in the axial groove of the respective cylinder -present as usual—by engagement of a magnetic strip with a metallic ferromagnetic portion of a side wall in the groove of printing machine cylinder. In accordance with a preferred embodiment, the magnetic strip includes multiple axially and radially positioned magnets which can clamp and retain the respective underlay between opposed magnets, and which magnets, additionally, are retained on a metallic portion of the cylinder position in the groove, for example a clamping bar or the substantially planar cylinder side wall itself.

DRAWING

DETAILED DESCRIPTION.

Figure 1:
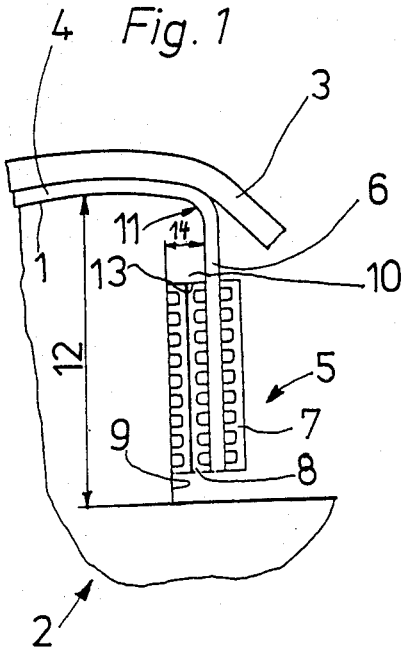
FIG. 1 is a fragmentary axial end view of a printing machine cylinder in the region of an axial groove, and illustrating one form of an attachment arrangement.
Figure 2:
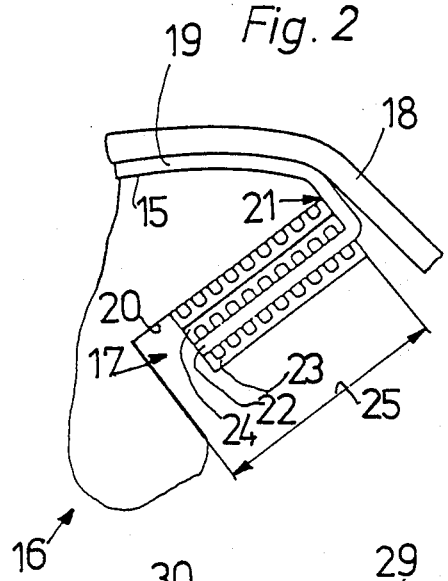
FIG. 2 illustrates another form of groove, with another form of attachment arrangement.
Figure 3:
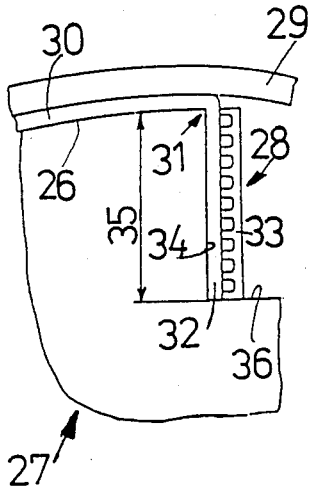
FIG. 3 is a view similar to FIG. 1, illustrating yet another arrangement.

The invention will be described in connection with rotary offset printing machines, and the drawings, FIGS. 1, 2 and 3, illustrate various forms of axial grooves of a rubber blanket cylinder 2 having a cylinder surface 1. The cylinder surface 1 has a rubber blanket 3 applied thereover, with an underlay 4 positioned between the surface 2 and the lower surface of the blanket 3. The clamping and holding arrangement for the rubber blanket 3 has been omitted from the drawing and may be of any conventional construction. The clamping arrangement for the blanket cylinder 2 is positioned in an axially extending groove 5. The underlay 4 has a forward angled-off portion 6.

In accordance with the invention, the angled-off portion 6 of the underlay 4 is retained between the magnetic side of a first magnetic foil strip 7 and a magnetic side of a second, double-acting magnetic foil strip 8. Thus, by positioning the end portion 6 between the foil strips 7, 8, the end portion 6 will be securely clamped by the interaction of magnetic forces acting perpendicularly through the underlay between the magnets 7, 8. The cylinder, as is customary, is made of steel. The side wall 9 of the cylinder 2, which forms one boundary or end surface of the groove 5, is in engagement with the oppositely directed magnets of the magnet strip 8. Thus, the end portion 6 and magnet strips 7, 8 are securely adhered together by magnetic forces and against the surface 9 of the side wall.

The side wall 9 is formed with a projection 10, of approximately rectangular cross section, positioned at the upper edge of groove 5. The entrance edge 11 of the groove 5 is recessed behind the projection 10. The depth of the groove 5 is shown by the dimension arrow 12 and extends somewaht deeper than the length of the end portion 6 of the underlay and of the magnetic strips. The lower edge 13 of the projection 10 forms a stop element for the upper edge of the second magnet foil strip 8. The width 14 of the projection 10 is so selected that it corresponds, at least approximately, to the thickness of the second magnet foil strip 8, so that the underlay 4 will bend smoothly about the edge 11.

FIG. 2: Groove 17 projects inwardly from the surface 15. The groove 17 retains a holding arrangement of any standard and well known construction for a rubber blanket 18. To retain the underlay 19 in position, magnetic foil strips 23, 24 are provided. The side wall 20 of the groove 17—in contrast to the embodiments shown in FIGS. 1 and 3—forms an acute angle with the entrance edge 21 of the groove. The forward angled-off portion 22 of the underlay 19 is retained between magnetized sides of first and second magnetic foil strips 23 and 24. The magnetic foil strip 24 is a dualacting magnetic foil strip, as schematically indicated in the drawing, representing small U magnets. The entire package is retained by the second magnetic foil strip 24 on the side wall 20 of the groove 17. The alignment, in the direction toward the axis of the cylinder, of the front edge of the intermediate layer or underlay 22 is obtained by aligning the upper edge of the second magnetic foil strip 24 with the entrance edge 21 of the groove 17, so that the strip 24 will fit against the corner defined by the entrance edge 21. The depth 25 of the groove 17 is somewhat deeper than the width of the magnetic foil strips 23 and 24.

Embodiment of FIG. 3: A printing machine cylinder 27 has a cylinder surface 26 in which a clamping groove 28 is formed, to receive the holding arrangement for the cover of the cylinder which, for example,may be a plate 29 or a rubber blanket. An underlay 30 is positioned between the cover layer 29 and the surface 26 of the cylinder 27. The entrance edge 31 of the groove 28 is at an essentially right angle; the forward portion 32 of the underlay 30 is fitted over the edge 31. The underlay is retained by a single simple magnetic foil strip 33 to adhere the underlay against the side wall 34 of the groove 28. The depth 35 of the groove 28 is so selected that it is equal to the width of the magnetic foil strip 33, or slightly larger. The leading edge of the underlay 30 and the lower edge of the magnetic foil strip 33 thus can be abutted against the bottom 36 of the groove 28 or spaced only very slightly therefrom.

Only the forward portions 6, 22 or 32 of the respective underlay 4, 19 or 30 is retained in the respective grooves 5, 17, 28. This feature is common to all the embodiments. The other end, not shown, is freely movable. Upon clamping the respective cover layer 3, 18 or 29 over the second entrance edge of the groove—not shown in the drawings and, for example, of a construction symmetrical to the edges 11, 21, 31, as shown—the other end of the underlay will be securely clamped in position by being stretched over the respective other edge.

The double-acting magnetic foil strips 8, 24 preferably are made by back-to-back adhesion of two simple magnetic foil strips. In accordance with a preferred feature of the invention, the magnetic foils form integrated U magnets, extending in axial direction, that is, parallel to the respective edges 11, 21, 31 of the groove. This arrangement of the magnetic insures that, upon placement of the first magnetic foil on the second, automatic parallel alignment of the foils with respect to each other will be obtained.

Various changes and modifications may be made, and features described in connection with any one of the embodiments may be used with any of the others. Thus, different combinations of the features shown and different embodiments can be used. The magnetic foils, for example, need not be adhered to a side wall of the clamping groove, but may be adhered to other magnetic portions, for example against a clamping spindle, typically also of steel; clamping rails, also frequently provided for rubber blankets and/or printing plates, may also form adhesion surfaces for the respective magnetic foils. Holding arrangments for rubber blankets and for printing plates in grooves are well known and the present invention can be used with any standard and suitable construction.

The clamping arrangement has the advantage of simplicity in attachment, and ease of handling, with secure holding of the underlay in position.

I claim:

1. In a printing machine, a cylinder (2, 16, 27) formed with an axial groove (5, 17, 28), and including a ferromagnetic surface located in the groove, an underlay holding arrangement to secure an underlay (4, 19, 30) of non-magnetic material beneath a printing surface cover (3,18, 29) placed on the cylinder over the underlay.

said underlay having an angled edge portion (6,22,32) adapted for attachment over a surface (1,15, 26) of the printing cylinder (2, 16, 27) of the printing machine, said arrangement comprising magnetic strip means (7, 8, 23, 24, 33) engaging said angled edge portion of the non-magnetic underlay (4, 19, 30) and being magnetically attached to a side wall (9,20, 34) of the groove (5, 17, 28) including said ferrogmagnetic surface and located within the axial groove (5, 17, 28); and wherein the magnetic strip means comprises a first strip element (7, 23) and a second strip element (8, 24), said edge portion (6, 22, 32) of the underlay being retained between said first and second magnetic strip elements, and clamped by interacting magnetic forces of said first and second strip elements;

and wherein one of said magnetic strips is in engagement with said ferromagnetic surface and magnetically retained thereon.

2. The arrangement of claim 1, including a circumferentially extending projection (10) extending from an edge (11) formed by the intersection of the groove (5) and the surface (1) of the cylinder, said projection (10) extending into the groove (5) by a width (14) corresponding to the thickness of the magnetic strip positioned between the edge portion (4) of the underlay and said surface (4);

and wherein the projection has a lower or inner end surface (13) forming an arrangement abutment for the upper edge of said magnetic foil strip (8).

3. The arrangement of claim 2, wherein said cylinder is a steel cylinder; and said ferromagnetic surface comprises a steel surface.

4. The arrangement of claim 1, wherein the double-sided magnetic foil strip (8, 24) comprises two single-sided magnetic foil strips, adhered back-to-back.

5. The arrangement of claim 4, wherein said cylinder is a steel cylinder; and said ferrogmagnetic surface comprises a steel surface.

* * * * *